US007232932B2

(12) United States Patent
Howell et al.

(10) Patent No.: US 7,232,932 B2
(45) Date of Patent: Jun. 19, 2007

(54) THERMALLY STABLE PERFLUOROPOLYETHERS AND PROCESSES THEREFOR AND THEREWITH

(75) Inventors: Jon L. Howell, Bear, DE (US); Erik William Perez, Pennsauken, NJ (US); Alfred Waterfeld, Tuscaloosa, AL (US); Chadron Mark Friesen, Langley (CA); Joseph Stuart Thrasher, Tuscaloosa, AL (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 625 days.

(21) Appl. No.: 10/813,525

(22) Filed: Mar. 30, 2004

(65) Prior Publication Data

US 2004/0186211 A1 Sep. 23, 2004

Related U.S. Application Data

(62) Division of application No. 09/901,975, filed on Jul. 10, 2001, now Pat. No. 6,753,301.

(51) Int. Cl.
*C43C 43/12* (2006.01)
*C08F 8/00* (2006.01)

(52) U.S. Cl. ..... 568/615; 524/404

(58) Field of Classification Search ..... 568/615; 570/101

See application file for complete search history.

(56) References Cited

U.S. PATENT DOCUMENTS

| | | | |
|---|---|---|---|
| 3,322,826 | A | 5/1967 | Moore |
| 3,505,411 | A | 4/1970 | Rice |
| 4,094,911 | A | 6/1978 | Mitsch et al. |
| 4,174,461 | A | 11/1979 | Sianesi et al. |
| 4,523,039 | A | 6/1985 | Lagow et al. |
| 4,666,977 | A | 5/1987 | Kihara et al. |
| 4,735,990 | A | 4/1988 | Kihara et al. |
| 4,845,268 | A | 7/1989 | Ohsaka et al. |
| 4,871,109 | A | 10/1989 | Kalota et al. |
| 4,996,368 | A | 2/1991 | Gries |
| 5,000,830 | A | 3/1991 | Marchionni et al. |
| 5,077,097 | A | 12/1991 | Moggi et al. |
| 5,084,146 | A | 1/1992 | Huang |
| 5,120,459 | A | 6/1992 | Kalota et al. |
| 5,154,845 | A | 10/1992 | Williams |
| 5,210,123 | A | 5/1993 | Caporiccio |
| 5,292,961 | A | 3/1994 | Marraccini et al. |
| 5,753,776 | A | 5/1998 | Bierschenk et al. |
| 5,804,687 | A | 9/1998 | Drivon et al. |
| 6,432,887 | B1 | 8/2002 | Yamamoto et al. |

FOREIGN PATENT DOCUMENTS

| | | | |
|---|---|---|---|
| EP | 0 195 946 | A2 | 1/1986 |
| EP | 0 340 739 | A2 | 8/1989 |
| EP | 0 344 547 | A2 | 12/1989 |
| EP | 0 346 946 | A2 | 3/1990 |
| EP | 0381 086 | | 8/1990 |
| EP | 0 472 423 | A2 | 2/1992 |
| EP | 0 148 482 | B1 | 3/1992 |
| EP | 0 803 526 | A2 | 10/1997 |
| GB | 1104482 | | 2/1968 |
| JP | 05-00982 | * | 8/1993 |
| JP | 94023121 | A | 3/1994 |
| WO | WO 90 03353 | A | 4/1990 |
| WO | WO 09115616 | A1 | 10/1991 |

OTHER PUBLICATIONS

Richard J. Lagow, Fluorine Compounds, Organic, *Kirk-Othmer Encyclopedia of Chemcial Technology*, 1994, pp. 467-499 and 528-534, vol. 11, John Wiley & Sons, New York, Chichester, Brisbane, Toronto, Singapore.

Dayal T. Meshri, Fluorinated Aliphatic Compounds, Organic, *Kirk-Othmer Encyclopedia of Chemcial Technology*, 1994, pp. 499-533, vol. 11, John Wiley & Sons, New York, Chichester, Brisbane, Toronto, Singapore.

Yohnosuke Ohsaka, Perfluoropolyether Fluids (Demnum®) Based on Oxetanes: Organoflurine Chemistry; pp. 463-467; ed. R.E. Banks et al; Plenum Press, New York, 1994.

Sianesi, D et al; Perluoropolyether (PFPEs) from Perfluoroolefin Photooxidation; Organofluirine Chemistry; pp. 431-461; ed. R.E. Banks et al; Plenum Press, New York, 1994.

* cited by examiner

*Primary Examiner*—Shaojia Anna Jiang
*Assistant Examiner*—MLouisa Lao

(57) ABSTRACT

A perfluoropolyether, a composition comprising the perfluoropolyether, a process for producing the perfluoropolyether, and a process for improving the thermostability of grease or lubricant are provided. The perfluoropolyether comprises perfluoroalkyl radical end groups in which the radical has at least 3 carbon atoms per radical and is substantially free of perfluoromethyl and perfluoroethyl end groups. The process for producing the perfluoropolyether can comprise (1) contacting a perfluoro acid halide, a $C_2$-to $C_4$-substituted ethyl epoxide, or a $C_{3+}$ fluoroketone with a metal halide to produce an alkoxide; (2) contacting the alkoxide with either hexafluoropropylene oxide or tetrafluorooxetane to produce a second acid halide; (3) esterifying the second acid halide to an ester; (4) reducing the ester to its corresponding alcohol; (5) converting the alcohol with a base to a salt form; (6) contacting the salt form with a $C_3$ or higher olefin to produce a fluoropolyether; and (7) fluorinating the fluoropolyether. The process for improving the thermostability of a grease or lubricant comprises combining the grease or lubricant with the composition.

25 Claims, No Drawings

THERMALLY STABLE PERFLUOROPOLYETHERS AND PROCESSES THEREFOR AND THEREWITH

This is a divisional application of Ser. No. 09/901,975, filed Jul. 10, 2001 now U.S. Pat. No. 6,753,301, now allowed.

FIELD OF THE INVENTION

The invention relates to a perfluoropolyether having improved thermostability over the presently available perfluoropolyethers, to a process therefor, and to a process therewith.

BACKGROUND OF THE INVENTION

Hereinafter trademarks or trade names are shown in upper case characters.

Perfluoropolyethers (hereinafter PFPE) are fluids having important uses in oils and greases for use under extreme conditions. A property shared by the class is extreme temperature stability in the presence of oxygen and they find use in tribological or lubrication applications. Among their advantages as extreme lubricants is the absence of gums and tars among the thermal decomposition products. In contrast to the gum and tar thermal degradation products of hydrocarbons, the degradation products of PFPE fluids are volatile. In actual use, the upper temperature limit is determined by the stability of the oil or grease. Lewis acids, metal fluorides such as aluminum trifluoride or iron trifluoride, are formed as a result of heat at microscale loci of metal to metal friction; for instance as stationary bearings are started in motion. Thus the PFPE stability in the presence of the metal fluoride, although lower than the stability in the absence of the metal fluoride, establishes the upper performance temperature. The three commercial PFPEs, KRYTOX (from E.I. du Pont de Nemours and Company, Inc., Wilmington Del.), FOMBLIN and GALDEN (from Ausimont/Montedison, Milan, Italy) and DEMNUM (from Daikin Industries, Osaka, Japan) differ in chemical structure. A review of KRYTOX is found in *Synthetic Lubricants and High-Performance Fluids*, Rudnick and Shubkin, Eds., Marcel Dekker, New York, N.Y., 1999 (Chapter 8, pp. 215-237). A review of FOMBLIN and GALDEN is found in *Organofluorine Chemistry*, Banks et al., Eds., Plenum, New York, N.Y., 1994, Chapter 20, pp. 431-461, and for DEMNUM, in *Organofluorine Chemistry* (*op. cit.*), Chapter 21, pp. 463-467.

The anionic polymerization of hexafluoropropylene epoxide as described by Moore in U.S. Pat. No. 3,332,826 can be used to produce the KRYTOX fluids. The resulting poly(hexafluoropropylene epoxide) PFPE fluids are hereinafter described as poly(HFPO) fluids. The initial polymer has a terminal acid fluoride, which is hydrolyzed to the acid followed by fluorination. The structure of a poly(HFPO) fluid is shown by Formula 1:

$$CF_3—(CF_2)_2—O—[CF(CF_3)—CF_2—O]_s—R_f \quad \text{(Formula 1)}$$

where s is 2-100 and $R_f$ is a mixture of $CF_2CF_3$ and $CF(CF_3)_2$, with the ratio of ethyl to isopropyl terminal group ranging between 20:1 to 50:1.

DEMNUM fluids are produced by sequential oligomerization and fluorination of 2,2,3,3-tetrafluorooxetane (tetrafluorooxetane), yielding the structure of Formula 2.

$$F—[(CF_2)_3—O]_t—R_f^2 \quad \text{(Formula 2)}$$

where $R_f^2$ is a mixture of $CF_3$ or $C_2F_5$ and t is 2-200.

A common characteristic of the PFPE fluids is the presence of perfluoroalkyl terminal groups.

The mechanism of thermal degradation in the presence of a Lewis acid such as aluminum trifluoride has been studied. Kasai (Macromolecules, Vol. 25, 6791-6799, 1992) discloses an intramolecular disproportionation mechanism for the decomposition of PFPE containing —O—$CF_2$—O— linkages in the presence of Lewis acids.

FOMBLIN and GALDEN fluids are produced by perfluoroolefin photooxidation. The initial product contains peroxide linkages and reactive terminal groups such as fluoroformate and acid fluoride. These linkages and end groups are removed by ultraviolet photolysis and terminal group fluorination, to yield the neutral PFPE compositions FOMBLIN Y and FOMBLIN Z represented by Formulae 3 and 4, respectively $$CF_3O(CF_2CF(CF_3)—O—)_m(CF_2—O—)_n—R_f^3 \quad \text{(Formula 3)}$$

where $R_f^3$ is a mixture of —$CF_3$, —$C_2F_5$, and —$C_3F_7$; (m+n) is 8-45; and m/n is 20-1000; and $$CF_3O(CF_2CF_2—O—)_p(CF_2—O)_qCF_3 \quad \text{(Formula 4)}$$

where (p+q) is 40-180 and p/q is 0.5-2. It is readily seen that Formulae 3 and 4 both contain the destabilizing —O—$CF_2$—O— linkage since neither n nor q can be zero. With this —O—$CF_2$—O— linkage in the chain, degradation within the chain can occur, resulting in chain fragmentation.

For PFPE molecules with repeating pendant —$CF_3$ groups, Kasai discloses the pendant group provides a stabilizing effect on the chain itself and for the alkoxy end groups adjacent to a —$CF(CF_3)$—. Absent the —O—$CF_2$—O— linkage, the PFPE is more thermally stable, but its eventual decomposition was postulated to occur at end away from the stabilizing —$CF(CF_3)$— group, effectively unzipping the polymer chain one ether unit at a time.

Therefore, there is substantial interest and need in increasing the thermal stability of PFPE fluids.

SUMMARY OF THE INVENTION

According to a first embodiment of the invention, a perfluoropolyether or a composition comprising thereof is provided, in which the perfluoropolyether comprises perfluoroalkyl radical end groups in which the radical has at least 3 carbon atoms per radical and is substantially free of perfluoromethyl and perfluoroethyl, and a 1,2-bis(perfluoromethyl)ethylene diradical, —$CF(CF_3)CF(CF_3)$—, is absent in the molecule of the perfluoropolyether.

According to a second embodiment of the invention, a process for improving the thermal stability of a perfluoropolyether is provided, which comprises modifying a process for producing a perfluoropolyether such that substantially all end groups of the perfluoropolyether have at least 3 carbon atoms per end group or, preferably, are $C_3$-$C_6$ branched and straight chain perfluoroalkyl end groups.

According to a third embodiment of the invention, a process is provided for producing a perfluoropolyether comprising perfluoroalkyl radical end groups in which the perfluoroalkyl radical has at least 3 carbon atoms per radical as disclosed in the first embodiment of the invention. The process can comprise (1) contacting a perfluoro acid halide, a $C_2$ to $C_4$-substituted ethylene epoxide, a $C_{3+}$ fluoroketone, or combinations of two or more thereof with a metal halide to produce an alkoxide; (2) contacting the alkoxide with either hexafluoropropylene oxide or 2,2,3,3-tetrafluorooxetane to produce a second acid halide; (3) esterifying the second acid halide to an ester; (4) reducing the ester to its corresponding alcohol; (5) converting the corresponding alcohol with a base to a salt form; (6) contacting the salt form with a $C_3$ or higher olefin to produce a fluoropolyether; and (7) fluorinating the fluoropolyether.

According to a fourth embodiment of the invention, a thermally stable grease or lubricant is provided, which comprises a thickener with a perfluoropolyether of composition thereof disclosed in the first embodiment of the invention.

DETAILED DESCRIPTION OF THE INVENTION

This invention is directed to a thermal stable perfluoropolyether (or PFPE) composition and processes for making and using the composition. The term "perfluoropolyether" and "PFPE fluid" ("PFPE" or "PFPE fluids") are, unless otherwise indicated, exchangeable.

According to the first embodiment of the invention, there is provided a perfluoropolyether comprising branched or straight chain perfluoroalkyl radical end groups, each of which has at least 3 carbon atoms per radical, is substantially free of perfluoromethyl and perfluoroethyl end groups and does not contain any 1,2-bis(perfluoromethyl)ethylene diradicals [—$CF(CF_3)CF(CF_3)$—] in the chain. The term "substantially", as used herein, refers to a perfluoropolyether or PFPE fluid of this invention having only trace $C_1$-$C_2$ perfluoroalkyl endgroups such that the initial decomposition in a specific use is inconsequential and tolerable. An unavoidable trace of remaining perfluoropolyether or PFPE molecules with a perfluoro-methyl or -ethyl end group, while not desirable, may be tolerable as such molecules degrade to volatile products, leaving the more stable PFPE molecules. Thus thermal stability increases after some initial degradation.

The preferred perfluoropolyethers have the formula of $C_rF_{(2r+1)}$—A—$C_rF_{(2r+1)}$ in which each r is independently 3 to 6; if r=3, both end groups $C_rF_{(2r+1)}$ are perfluoropropyl radicals; A can be O—$(CF(CF_3)CF_2$—$O)_w$, O—$(CF_2$—$O)_x(CF_2CF_2$—$O)_y$, O—$(C_2F_4$—$O)_x$, O—$(C_2F_4$—$O)_x(C_3F_6$—$O)_y$, O—$(CF(CF_3)CF_2$—$O)_x(CF_2$—$O)_y$, $O(CF_2CF_2CF_2O)_w$, O—$(CF(CF_3)CF_2$—$O)_x(CF_2CF_2$—$O)_y$—$(CF_2$—$O)_z$, or combinations of two or more thereof; preferably A is O—$(CF(CF_3)CF_2$—$O)_w$, O—$(C_2F_4$—$O)_x$, $O(C_2F_4O)_x(C_3F_6$—$O)_y$, O—$(CF_2CF_2CF_2$—$O)_x$, or combinations of two or more thereof; w is 4 to 100; x, y, and z are each independently 1 to 100.

Such compositions, as illustrated in the EXAMPLES section, show a significant increase in thermal stability over the corresponding PFPE fluids having perfluoroethyl or perfluoromethyl end groups. Similarly, stability of those PFPE fluids subject to degradation at the perfluoroalkyl terminal group, in addition to those based on poly(HFPO), can be improved by replacing —$CF_3$ and —$C_2F_5$ groups with, for example, $C_3$-$C_6$ perfluoroalkyl groups.

According to the second embodiment of the invention, a process for improving the thermal stability of a perfluoropolyether is provided. The process can comprise (1) incorporating one $C_{3+}$ terminal segment into a perfluoropolyether precursor to produce a precursor having an initial $C_{3+}$ end group; (2) polymerizing the precursor having an initial $C_{3+}$ end group to a desired molecular weight polymer containing an alkoxide growing chain; (3) incorporating a second $C_{3+}$ end group to produce a polyether having both $C_{3+}$ end groups; and (4) fluorinating the polyether having both $C_{3+}$ end groups. The term "$C_3$+" refers to 3 or more carbon atoms.

Several processes are available for producing a PFPE fluid having improved thermal stability. The process is more fully disclosed in the third embodiment of the invention, other similar processes are evident to those skilled in the art. For example purposes, poly(HFPO) fluids are subject to exacting fractional distillation under vacuum. In practice, the upper molecular weight limit for such a distillation is the separation and isolation of $F(CF(CF_3)$—$CF_2$—$O)_9$—$CF_2CF_3$ and $F(CF(CF_3)$—$CF_2$—$O)_9$—$CF(CF_3)_2$. The increased thermal stability of free fluids with perfluoropropyl and perfluorohexyl end groups over those with perfluoroethyl end groups, described in the EXAMPLES, demonstrates the present invention.

The invention discloses perfluoropolyether having preferred $C_3$-$C_6$ perfluoroalkyl ether end groups. It is, however, within the scope of the invention that the disclosure is also applicable to any $C_{3+}$ perfluoroalkyl ether end group. In the case of KRYTOX, for instance, the resultant poly(HFPO) chain terminates at both ends with $C_3$-$C_6$ perfluoroalkyl groups, having the formula of $$C_rF_{(2r+1)}—O—[—CF(CF_3)—CF_2—O—]_s—C_rF_{(2r+1)} \quad \text{(Formula 5)}$$

According to the third embodiment of the invention, a process for producing a preferred perfluoropolyether in which substantially all perfluoroalkyl end groups of the perfluoropolyether contain at least three, preferably 3 to 6, carbon atoms per end group. The preferred perfluoropolyether has the formula of $C_rF_{(2r+1)}$—A—$C_rF_{(2r+1)}$ as disclosed in the first embodiment of the invention. The process can comprise (1) contacting a perfluoro acid halide, a $C_2$ to $C_4$-substituted ethylene epoxide, a $C_{3+}$ fluoroketone, or combinations of two or more thereof with a metal halide to produce an alkoxide; (2) contacting the alkoxide with either hexafluoropropylene oxide or tetrafluorooxetane to produce a second acid fluoride; (3) contacting the second acid fluoride with an alcohol to produce an ester; (4) reducing the ester to corresponding alcohol: (5) contacting the corresponding alcohol with a base to a salt form; (6) contacting the salt form with a $C_{3+}$ or higher olefin to produce a fluoropolyether; and (7) fluorinating the fluoropolyether to produce the perfluoropolyether of the invention.

Typically, one $C_{3+}$ terminal segment is produced first (the "initial end group") followed by its polymerization using, for example, hexafluoropropylene oxide or tetrafluorooxetane to a desired molecular weight polymer. This polymer is thermally treated to convert the growing alkoxide chain to an acid fluoride. The acid fluoride is converted to an ester, which is then reduced to its corresponding alcohol. The second $C_{3+}$ terminal group (the "final end group") is now incorporated into the polymer by, for example, treatment with a mineral base in a suitable solvent and the addition of a reactive hydro- or fluoro-olefin. Reactive hydroolefins include allyl halides and tosylates. Finally the PFPE is formed by replacing essentially all hydrogen atoms with fluorine atoms.

Process 1 discloses a process for producing PFPEs terminated with paired normal $C_3$ to $C_6$ end groups. The process comprises (1) contacting a perfluoro acid halide or a $C_2$ to $C_4$-substituted ethylene epoxide with a metal halide to produce an alkoxide; (2) contacting the alkoxide with either hexafluoropropylene oxide or tetrafluorooxetane to produce a second acid halide; (3) contacting the second acid halide with an alcohol to produce an ester; (4) reducing the ester to corresponding alcohol: (5) contacting the corresponding alcohol with a base to a salt form; (6) contacting the salt form with a $C_{3+}$ olefin to produce a fluoropolyether; and (7) fluorinating the fluoropolyether to produce the perfluoropolyether of the invention. The preferred halide, unless otherwise indicated, is fluoride and the preferred base is a metal hydroxide such as, for example, alkali metal hydroxide as used below to illustrate these steps.

Step 1 involves the contact of either a $C_3$-$C_6$ perfluoro acid fluoride or a $C_2$ to $C_4$ substituted ethylene epoxide with a metal fluoride, such as CsF or KF, in a suitable solvent such as tetraethylene glycol dimethyl ether at temperatures from about 0° to about 100° C. to form an alkoxide which can be further polymerized.

$$R_f^4COF + MF \longrightarrow R_f^4CF_2O^-M^+$$

$$R_f^1-\underset{\underset{O}{\diagdown\diagup}}{CF-CF_2} + MF \longrightarrow R_f^1CF_2CF_2O^-M^+,$$

where preferred M is a metal such as cesium or potassium, $R_f^4$ is $C_aF_{(2a+1)}$, a is 2 to 5, $R_f^1$ is $C_bF_{(2b+1)}$, and b is 1 to 4.

Step 2 involves the contact of the alkoxide with either hexafluoropropylene oxide or tetrafluorooxetane at low temperature, about −30 to about 0° C., followed by thermolysis at >50° C., to produce the PFPE with one $C_3$-$C_6$ end group and an acid fluoride on the other terminus, and having the Formula 6 (from HFPO) or Formula 7 (from tetrafluorooxetane).

$$(C_3\text{-}C_6\ \text{Segment})(HFPO)_sCF(CF_3)COF \qquad \text{(Formula 6)}$$

or $$(C_3\text{-}C_6\ \text{Segment})(CH_2CF_2CF_2O)_tCH_2CF_2COF, \qquad \text{(Formula 7)}$$

The ($C_3$-$C_6$ Segment) is defined $C_3$-$C_6$ perfluoroalkyl group having an oxygen between the segment and the polymer repeat unit.

Alternatively, Formula 7 can be converted to an equivalently useful acid fluoride by replacing all methylene hydrogen radicals with fluorine radicals using the fluorination procedure disclosed in Step 7, with or with out the use of a suitable solvent, at temperatures of about 0 to about 180° C., and with autogenous or elevated fluorine pressures of 0 to 64 psig (101 to 543 kPa). The resulting perfluorinated acid fluoride is then further processed as follows.

$$(C_3\text{-}C_6\ \text{Segment})(CH_2CF_2CF_2O)_sCH_2CF_2COF + F_2 \longrightarrow (C_3\text{-}C_6\ \text{Segment})(CF_2CF_2CF_2O)_sCF_2CF_2COF.$$

Step 3 involves the contact of the acid fluoride with an alcohol such as methanol, with or without solvent or excess alcohol, at a temperature of about 0 to about 100° C., producing the corresponding ester. The HF produced can be removed by washing with water.

$$(C_3\text{-}C_6\ \text{Segment})(HFPO)_sCF(CF_3)COF + R^1OH \longrightarrow (C_3\text{-}C_6\ \text{Segment})(HFPO)_sCF(CF_3)COOR^1,$$

$$(C_3\text{-}C_6\ \text{SEGMENT})(CH_2CF_2CF_2O)_TCH_2CF_2COF + R^1OH \longrightarrow$$

-continued $$(C_3\text{-}C_6\ \text{Segment})(CH_2CF_2CF_2O)_tCH_2CF_2COOR^1,$$

where $R^1$ is alkyl and preferably methyl.

In Step 4, the ester is reduced with a reducing agent such as, for example, sodium borohydride or lithium aluminum hydride in a solvent such as an alcohol or THF (tetrahydrofuran) at a range of temperatures (0 to 50° C.) and at autogenous pressure for a time period of from about 30 minutes to about 25 hours to produce the corresponding alcohol (PFPE precursor):

$$(C_3\text{-}C_6\ \text{Segment})(HFPO)_sCF(CF_3)COOR^1 + NaBH_4 \longrightarrow (C_3\text{-}C_6\ \text{Segment})(HFPO)_sCF(CF_3)CH_2OH,$$

$$(C_3\text{-}C_6\ \text{Segment})(CH_2CF_2CF_2O)_tCH_2CF_2COOR^1 + NaBH_4 \longrightarrow (C_3\text{-}C_6\ \text{Segment})(CH_2CF_2CF_2O)_tCH_2CF_2CH_2OH.$$

In Step 5, the PFPE precursor alcohol is converted to a metal salt. The conversion can be effected by contacting the precursor alcohol with a metal hydroxide, optionally in a solvent, under a condition sufficient to produce the metal salt. The presently preferred metal hydroxide includes alkali metal hydroxides such as, for example, potassium hydroxide and alkaline earth metal hydroxides. Any solvent, such as, for example, acetonitrile, that does not interfere with the production of the metal salt can be used. Suitable condition include a temperature in the range of from about 20 to about 100° C. under a pressure of about 300 to about 1,000 mmHg (40-133 kPa) for about 30 minutes to about 25 hours.

$$(C_3\text{-}C_6\ \text{Segment})(HFPO)_sCF(CF_3)CH_2OH + M^1OH \longrightarrow (C_3\text{-}C_6\ \text{Segment})(HFPO)_sCF(CF_3)CH_2OM^1,$$

$$(C_3\text{-}C_6\ \text{Segment})(CH_2CF_2CF_2O)_tCH_2CF_2CH_2OH + M^1OH \longrightarrow (C_3\text{-}C_6\ \text{Segment})(CH_2CF_2CF_2O)_tCH_2CF_2CH_2OM^1,$$

where $M^1$ is an alkali metal, an alkaline earth metal, or ammonium.

In Step 6, the metal salt is contacted with an olefin to produce a $C_3$-$C_6$ segment fluoropolyether. The contacting can be carried out in the presence of a solvent such as, for example, an ether or alcohol, under a condition to produce a fluoropolyether that can be converted to perfluoropolyether of the invention by fluorination disclosed herein below. Any olefin having more than three carbon atoms, preferably 3 to 6, can be used. The olefin can also be substituted with, for example, a halogen. Examples of such olefins include, but are not limited to, hexafluoropropylene, octafluorobutene, perfluorobutylethylene, perfluoroethylethylene, perfluorohexene, allyl halides, and combinations of two or more thereof. Additionally, a $C_3$-$C_6$ segment containing a moiety known in the art to be a good leaving group in nucleophilic displacement reactions, for example tosylates, can also be used. The contacting conditions can include a temperature in the range of from about 0 to about 100° C. under a pressure in the range of from about 0.5 to about 64 psig (105-543 kPa) for about 30 minutes to about 25 hours.

$$(C_3\text{-}C_6\ \text{Segment})(HFPO)_sCF(CF_3)CH_2OM^1 + R_f^1CF{=}CF_2 \longrightarrow (C_3\text{-}C_6\ \text{Segment})(HFPO)_sCF(CF_3)CH_2OCF_2CFHR_f^1 + (C_3\text{-}C_6\ \text{Segment})(HFPO)_sCF(CF_3)CH_2OCF{=}CFR_f^1;\ \text{or}$$

$$(C_3\text{-}C_6\ \text{Segment})(HFPO)_sCF(CF_3)CH_2OM^1 + X^1CHR^2CH{=}CH_2 \longrightarrow (C_3\text{-}C_6\ \text{Segment})(HFPO)_sCF(CF_3)CH_2OCH_2CH{=}CHR^2$$

where $R^2$ is $C_cH_{(2c+1)}$, c is 0 to 3, and $X^1$ is a halogen; or $$(C_3\text{-}C_6\ \text{Segment})(HFPO)_sCF(CF_3)CH_2OM^1 + R_f^5CF_2CH{=}CH_2 \longrightarrow (C_3\text{-}C_6\ \text{Segment})(HFPO)_sCF(CF_3)CH_2OCH_2CH_2CF_2R_f^5 + (C_3\text{-}C_6\ \text{Segment})(HFPO)_sCF(CF_3)CH_2OCH_2CH{=}CFR_f^5$$

where $R_f^5$ is $C_cF_{(2c+1)}$; or $$(C_3\text{-}C_6\ \text{Segment})(CH_2CF_2CF_2O)_tCH_2CF_2CH_2OM^1 + R_f^1CF{=}CF_2 \longrightarrow (C_3\text{-}C_6\ \text{Segment})(CH_2CF_2CF_2O)_tCH_2CF_2CH_2OCF_2CFHR_f^1 + (C_3\text{-}C_6\ \text{Segment})(CH_2CF_2CF_2O)_tCH_2CF_2CH_2OCF{=}CFR_f^1;\ \text{or}$$

$$(C_3\text{-}C_6\ \text{Segment})(CH_2CF_2CF_2O)_tCH_2CF_2CH_2OM^1 + X^1CHR^2CH{=}CH_2 \longrightarrow (C_3\text{-}C_6\ \text{Segment})(CH_2CF_2CF_2O)_tCH_2CF_2CH_2OCH_2CH{=}CHR^2;\ \text{or}$$

$$(C_3\text{-}C_6\ \text{Segment})(CH_2CF_2CF_2O)_tCH_2CF_2CH_2OM^1 + R_f^5CF_2CH{=}CH_2 \longrightarrow (C_3\text{-}C_6\ \text{Segment})(CH_2CF_2CF_2O)_tCH_2CF_2CH_2OCH_2CH_2CF_2R_f^5 + (C_3\text{-}C_6\ \text{Segment})(CH_2CF_2CF_2O)_tCH_2CF_2CH_2OCH_2CH{=}CFR_f^5.$$

In Step 7, the perfluoropolyether with paired $C_3$ to $C_6$ segments is formed with elemental fluorine using any technique known to one skilled in the art such as disclosed in Kirk-Othmer Encyclopedia of Chemical Technology, Fourth Edition, Vol. 11, page 492 and references therein.

$$(C_3\text{-}C_6\ \text{Segment})(HFPO)_sCF(CF_3)CH_2OCF_2CFHR_f^1 + (C_3\text{-}C_6\ \text{Segment})(HFPO)_sCF(CF_3)\ CH_2OCF{=}CFR_f^1 + F_2 \longrightarrow (C_3\text{-}C_6\ \text{Segment})(HFPO)_sCF(CF_3)CF_2OCF_2CFR_f^1;\ \text{or}$$

$$(C_3\text{-}C_6\ \text{Segment})(HFPO)_sCF(CF_3)\ CH_2OCH_2CH{=}CHR^2 + F_2 \longrightarrow (C_3\text{-}C_6\ \text{Segment})(HFPO)_sCF(CF_3)CF_2OCF_2CF_2CF_2R_f^5;\ \text{or}$$

$$(C_3\text{-}C_6\ \text{Segment})(HFPO)_sCF(CF_3)CH_2OCH_2CH_2CF_2R_f^5 + (C_3\text{-}C_6\ \text{Segment})(HFPO)_sCF(CF_3)\ CH_2OCH_2CH{=}CFR_f^1 + F_2 \longrightarrow (C_3\text{-}C_6\ \text{Segment})(HFPO)_sCF(CF_3)CF_2OCF_2CF_2CF_2R_f^5;\ \text{or}$$

$$(C_3\text{-}C_6\ \text{Segment})(CH_2CF_2CF_2O)_tCH_2CF_2CH_2OCF_2CFHR_f^1 + (C_3\text{-}C_6\ \text{Segment})(CH_2CF_2CF_2O)_t\ CH_2CF_2CH_2OCF{=}CFR_f^1 + F_2 \longrightarrow (C_3\text{-}C_6\ \text{Segment})(CF_2CF_2CF_2O)_sCF_2CF_2CF_2OCF_2CF_2R_f^1;\ \text{or}$$

$$(C_3\text{-}C_6\ \text{Segment})(CH_2CF_2CF_2O)_t\ CH_2CF_2CH_2OCH_2CH{=}CHR^2 + F_2 \longrightarrow (C_3\text{-}C_6\ \text{Segment})(CF_2CF_2CF_2O)_tCF_2CF_2CF_2OCF_2CF_2CF_2R_f^5;\ \text{or}$$

$$(C_3\text{-}C_6\ \text{Segment})(CH_2CF_2CF_2O)_T\ CH_2CF_2CH_2OCH_2CH{=}CFR_F^5 + F_2 \longrightarrow (C_3\text{-}C_6\ \text{Segment})(CF_2CF_2CF_2O)_tCF_2CF_2CF_2OCF_2CF_2CF_2R_f^5.$$

Process 2 discloses the synthesis of PFPEs terminated with a normal $C_3$ to $C_6$ initial end group and a branched $C_3$ to $C_6$ final end group. Steps 1 to 5 are the same as those in Process 1. The terminal fluoroalkene or allyl halide in Step 6 is replaced with a branched fluoroalkene such as 2-perfluorobutene or a branched allyl halide such as 1-bromo-2-butene. Step 7 is as described in Process 1.

$$(C_3\text{-}C_6\ \text{Segment})(HFPO)_sCF(CF_3)CH_2OH + M^1OH + R_f^6CF{=}CFR_f^7 \longrightarrow (C_3\text{-}C_6\ \text{Segment})(HFPO)_sCF(CF_3)CH_2OCF(R_f^6)CFHR_f^7 + (C_3\text{-}C_6\ \text{Segment})(HFPO)_sCF(CF_3)CH_2OC(R_f^6){=}CFR_f^7$$

where $R_f^6$ is $C_eF_{(2e+1)}$, $R_f^7$ is $C_fF_{(2f+1)}$, such that e and f ≥ 0, (e +f) ≤ 4 and (e + f) ≥ 1; or $$(C_3\text{-}C_6\ \text{Segment})(HFPO)_sCF(CF_3)CH_2OH + M^1OH + X^1CR^4CH{=}CHR^5 \longrightarrow (C_3\text{-}C_6\ \text{Segment})(HFPO)_sCF(CF_3)CH_2OCH(R^5)CH{=}CHR^4$$

where $R^4$ is $C_gH_{(2g+1)}$, $R^5$ is $C_hH_{(2h+1)}$, such that g and h ≥ 0 and (g + h) is 1 to 3.

Process 3A discloses the synthesis of PFPEs terminated with a branched $C_3$ to $C_6$ initial end group and a normal $C_3$ to $C_6$ final end group. The reagents, either the acid fluoride or epoxide, in Step 1 of Process 1, are replaced with a $C_3$ to $C_6$ fluoroketone. Then, steps 2 to 7 of Process 1 are used.

$$R_f^8C(O)R_f^9 + MF \longrightarrow R_f^8(R_f^9)CFO^-M^+,$$

where $R_f^8$ is $C_jF_{(2j+1)}$, $R_f^9$ is $C_kF_{(2k+1)}$, such that j and k ≥ 1, (j + k) ≤ 5

Process 3B discloses the synthesis of PFPEs terminated with paired branched $C_3$ to $C_6$ end groups. Step 1 of Process 3 is practiced, followed by Steps 2 to 5 of Process 1, followed by Step 6 of Process 2A, and then finally Step 7 of Process 1.

Process 4 discloses the synthesis of PFPEs terminated with a $C_3$ to $C_6$ initial end group and a $C_3$ to $C_6$ final end group. Steps 1 to 3 of Process one; or Steps 1 of Process 3A and steps 2 and 3 of Process 1 are followed. The ester is then contacted with a Grignard Reagent of the type $C_2H_5M^2X^1$ or $CH_3M^2X^1$, where $M^2$ is magnesium or lithium, forming the carbinol which can either be dehydrated or fluorinated directly in Step 7 as described in Process 1 to the desired PFPE. Steps 4 through 6 disclosed in Process 1 are omitted.

$$(C_3\text{-}C_6\ \text{Segment})(HFPO)_sCF(CF_3)C(O)OR^1 + 2R^6M^2X^1 \longrightarrow (C_3\text{-}C_6\ \text{Segment})(HFPO)_sCF(CF_3)C(OH)(R^6)_2,$$

$$(C_3\text{-}C_6\ \text{Segment})(CH_2CF_2CF_2O)_tCH_2CF_2COOR^1 + 2R^6M^2X^1 \longrightarrow$$

-continued $$(C_3\text{-}C_6\ \text{Segment})(CH_2CF_2CF_2O)_tCH_2CF_2C(OH)(R^6)_2,$$

where $R^6$ is $CH_3$ or $C_2H_5$ such that the total number of carbons in the final segment is 3 to 6 and $(R^6)_2$ always means no more than one $CH_3$ and one $C_2H_5$.

Alternatively, $(C_3\text{-}C_6\ \text{Segment})(CF_2CF_2CF_2O)_tCF_2CF_2COOR^1$ +

$$2R^6M^2X^1 \longrightarrow (C_3\text{-}C_6\ \text{Segment})(CF_2CF_2CF_2O)_tCF_2CF_2C(OH)(R^6)_2.$$

Process 5 discloses an additional procedure for making PFPEs with a $C_3$-$C_6$ initial end group with a branched or normal $C_3$-$C_6$ final end group, which comprises (1) contacting a PFPE acid fluoride precursor prepared in steps 1 and 2 of Process 1 or steps 1 and 2 of Process 3 with a metal iodide such as, for instance, lithium iodide at an elevated temperatures such as, for example, at least 180° C., or at least 220° C., to produce a corresponding iodide; (2) either replacing the iodine radical with a hydrogen radical using a suitable reducing agent such as, for example, sodium methylate at temperatures of about 25° C. to about 150° C. and autogenous pressure alone or reacting said iodide with a $C_2$ to $C_4$ olefin using a peroxide or azo catalyst or zero valent metal catalyst, or dehydrohalogenating the iodide/olefin adduct in alcoholic solvent; and (3) fluorinating the corresponding products to produce the desired perfluoropolyether.

Process 5 Step 1

$$(C_3\text{-}C_6\ \text{Segment})(HFPO)_sCF(CF_3)COF + LiI \longrightarrow (C_3\text{-}C_6\ \text{Segment})(HFPO)_sCF(CF_3)I + LiF + CO,$$

$$(C_3\text{-}C_6\ \text{Segment})(CF_2CF_2CF_2O)_tCF_2CF_2COF + LiI \longrightarrow (C_3\text{-}C_6\ \text{Segment})(CF_2CF_2CF_2O)_tCF_2CF_2I + LiF + CO,$$

$$\{R_f^8(R_f^9)\text{CFO Segment}\}(HFPO)_sCF(CF_3)COF + LiI \longrightarrow \{R_f^8(R_f^9)\text{CFO Segment}\}(HFPO)_sCF(CF_3)I + LiF + CO;$$

$$(C_3\text{-}C_6\ \text{Segment})(HFPO)_sCF(CF_3)COF + LiI \longrightarrow (C_3\text{-}C_6\ \text{Segment})(HFPO)_{(s-1)}CF(CF_3)CF_2I + CF_3COF + LiF + CO;$$

$$\{R_f^8(R_f^9)\text{CFO Segment}\}(HFPO)_sCF(CF_3)COF + LiI \longrightarrow \{R_f^8(R_f^9)\text{CFO Segment}\}(HFPO)_{(s-1)}CF(CF_3)CF_2I + CF_3COF + LiF + CO.$$

Process 5 Step 2A $$(C_3\text{-}C_6\ \text{Segment})(HFPO)_sCF(CF_3)I + CX_2{=}CXR^7 \longrightarrow (C_3\text{-}C_6\ \text{Segment})(HFPO)_sCF(CF_3)CX_2CXIR^7$$

where X = H or F, $R^7 = C_dX_{(2d+1)}$, d = 0 to 2;

$$(C_3\text{-}C_6\ \text{Segment})(CF_2CF_2CF_2O)_tCF_2CF_2I + CX_2{=}CXR^7 \longrightarrow (C_3\text{-}C_6\ \text{Segment})(CF_2CF_2CF_2O)_tCF_2CF_2CX_2CXIR^7;$$

-continued $$\{R_f^8(R_f^9)\text{CFO Segment}\}(HFPO)_sCF(CF_3)I + CX_2{=}CXR^7 \longrightarrow \{R_f^8(R_f^9)\text{CFO Segment}\}(HFPO)_sCF(CF_3)CX_2CXIR^7;$$

$$(C_3\text{-}C_6\ \text{Segment})(HFPO)_{(s-1)}CF(CF_3)CF_2I + CX_2{=}CXR^8 \longrightarrow (C_3\text{-}C_6\ \text{Segment})(HFPO)_{(s-1)}CF(CF_3)CF_2CX_2CXIR^8$$

where $R^8 = C_vX_{(2v+1)}$, v = 0 to 1;

$$\{R_f^8(R_f^9)\text{CFO Segment}\}(HFPO)_{(s-1)}CF(CF_3)CF_2I + CX_2{=}CXR^8 \longrightarrow \{R_f^8(R_f^9)\text{CFO Segment}\}(HFPO)_{(s-1)}CF(CF_3)CF_2CX_2CXIR^8.$$

Process 5 2A1, when one X of the terminal methylene from the olefin of process 5 Step 2A was Hydrogen $$(C_3\text{-}C_6\ \text{Segment})(HFPO)_sCF(CF_3)CX_2CXIR^7 + M^1OH \longrightarrow (C_3\text{-}C_6\ \text{Segment})(HFPO)_sCF(CF_3)\ CX{=}CXR^7;\ \text{or}$$

$$(C_3\text{-}C_6\ \text{Segment})(CF_2CF_2CF_2O)_sCF_2CF_2CX_2CXIR^7 + M^1OH \longrightarrow (C_3\text{-}C_6\ \text{Segment})(CF_2CF_2CF_2O)_sCF_2CF_2\ CX{=}CXR^7;\ \text{or}$$

$$\{R_f^8(R_f^9)\text{CFO Segment}\}(HFPO)_sCF(CF_3)CX_2CXIR^8 + M^1OH \longrightarrow \{R_f^8(R_f^9)\text{CFO Segment}\}(HFPO)_sCF(CF_3)CX{=}CXR^8;\ \text{or}$$

$$(C_3\text{-}C_6\ \text{Segment})(HFPO)_{(s-1)}CF(CF_3)CF_2CX_2CXIR^8 + M^1OH \longrightarrow (C_3\text{-}C_6\ \text{Segment})(HFPO)_{(s-1)}CF(CF_3)\ CF_2CX{=}CXR^8;\ \text{or}$$

$$\{R_f^8(R_f^9)\text{CFO Segment}\}(HFPO)_{(s-1)}CF(CF_3)CF_2CX_2CXIR^8 + M^1OH \longrightarrow \{R_f^8(R_f^9)\text{CFO Segment}\}(HFPO)_{(s-1)}CF(CF_3)CF_2CX{=}CXR^8.$$

Process 5 Step 2B $$(C_3\text{-}C_6\ \text{Segment})(HFPO)_{(s-1)}CF(CF_3)CF_2I + NaOCH_3/HOCH_3 \longrightarrow (C_3\text{-}C_6\ \text{Segment})(HFPO)_{(s-1)}CF(CF_3)CF_2H,\ \text{or}$$

$$\{R_f^8(R_f^9)\text{CFO Segment}\}(HFPO)_{(s-1)}CF(CF_3)CF_2I + NaOCH_3/HOCH_3 \longrightarrow \{R_f^8(R_f^9)\text{CO Segment}\}(HFPO)_{(s-1)}CF(CF_3)CF_2H.$$

Process 5 Step 3A $$(C_3\text{-}C_6\ \text{Segment})(HFPO)_{(s-1)}CF(CF_3)CF_2I + F_2 \longrightarrow (C_3\text{-}C_6\ \text{Segment})(HFPO)_{(s-1)}CF(CF_3)CF_3;\ \text{or}$$

$$\{R_f^8(R_f^9)\text{CFO Segment}\}(HFPO)_{(s-1)}CF(CF_3)CF_2I + F_2 \longrightarrow R_f^8(R_f^9)\text{CFO Segment}\}(HFPO)_{(s-1)}CF(CF_3)CF_3.$$

Process 5 Step 3B $$(C_3\text{-}C_6\ \text{SEGMENT})(HFPO)_{(s-1)}CF(CF_3)CF_2H + F_2 \longrightarrow$$

-continued $$(C_3\text{-}C_6\ \text{SEGMENT})(HFPO)_{(s-1)}CF(CF_3)CF_3;\ \text{OR}$$

$$\{R_f^8(R_f^9)CFO\ \text{Segment}\}(HFPO)_{(s-1)}CF(CF_3)CF_2H + F_2 \longrightarrow \{R_f^8(R_f^9)CFO\ \text{Segment}\}(HFPO)_{(s-1)}CF(CF_3)CF_3.$$

Process 5 Step 3C $$(C_3\text{-}C_6\ \text{Segment})(HFPO)_{(s-1)}CF(CF_3)CX_2CXIR^7 + F_2 \longrightarrow (C_3\text{-}C_6\ \text{Segment})(HFPO)_sCF(CF_3)CF_2CF_2R_f^{10},\ \text{where}\ R_f^{10} = C_dF_{(2d+1)},\ \text{or}$$

$$(C_3\text{-}C_6\ \text{Segment})(CF_2CF_2CF_2O)_tCF_2CF_2CX_2CXIR^7 + F_2 \longrightarrow (C_3\text{-}C_6\ \text{Segment})(CF_2CF_2CF_2O)_tCF_2CF_2CF_2CF_2R_f^{10};\ \text{or}$$

$$\{R_f^8(R_f^9)CO\ \text{Segment}\}(HFPO)_sCF(CF_3)CX_2CXIR^7 + F_2 \longrightarrow \{R_f^8(R_f^9)CO\ \text{Segment}\}(HFPO)_sCF(CF_3)CF_2CF_2R_f^{10};\ \text{or}$$

$$(C_3\text{-}C_6\ \text{Segment})(HFPO)_{(s-1)}CF(CF_3)CF_2CX_2CXIR^8 + F_2 \longrightarrow (C_3\text{-}C_6\ \text{Segment})(HFPO)_{(s-1)}CF(CF_3)CF_2CF_2CF_2R_f11\ \text{where}\ R_f^{11} = Cv_{F(2v+1)},\ \text{or}$$

$$\{R_F^8(R_F^9)CO\ \text{SEGMENT}\}(HFPO)_{(S-1)}CF(CF_3)CF_2CX_2CXIR^8 + F_2 \longrightarrow \{R_F^8(R_F^9)CO\ \text{SEGMENT}\}(HFPO)_{(S-1)}CF(CF_3)CF_2CF_2CXF_2R_F^{11}.$$

Process 5 Step 3D $$(C_3\text{-}C_6\ \text{Segment})(HFPO)_{(s)}CF(CF_3)CX_2{=}CXR^7 + F_2 \longrightarrow (C_3\text{-}C_6\ \text{Segment})(HFPO)_{(s)}CF(CF_3)CF_2CF_2R_f^{10},\ \text{or}$$

$$(C_3\text{-}C_6\ \text{Segment})(CF_2CF_2CF_2O)_tCF_2CF_2CX_2{=}CXR^7 + F_2 \longrightarrow (C_3\text{-}C_6\ \text{Segment})(CF_2CF_2CF_2O)_tCF_2CF_2CF_2CF_2R_f^{10};\ \text{or}$$

$$\{R_f^8(R_f^9)CO\ \text{Segment}\}(HFPO)_sCF(CF_3)CX{=}CXR^7 + F_2 \longrightarrow \{R_f^8(R_f^9)CO\ \text{Segment}\}(HFPO)_sCF(CF_3)CF_2CF_2R_f^{10};\ \text{or}$$

$$(C_3\text{-}C_6\ \text{Segment})(HFPO)_{(s-1)}CF(CF_3)CF_2CX{=}CXR^8 + F_2 \longrightarrow (C_3\text{-}C_6\ \text{Segment})(HFPO)_{(s-1)}CF(CF_3)CF_2CF_2CF_2R_f11,\ \text{or}$$

$$\{R_F^8(R_F^9)CO\ \text{SEGMENT}\}(HFPO)_{(S-1)}CF(CF_3)CF_2CX{=}CXR^8 + F_2 \longrightarrow \{R_f^8(R_f^9)CO\ \text{Segment}\}(HFPO)_{(s-1)}CF(CF_3)CF_2CF_2CF_2R_f^{11}.$$

Process 6 discloses the synthesis of PFPEs terminated with $C_3$-$C_6$ end groups by the fluorination of corresponding hydrocarbon polyethers, following the process described in Kirk-Othmer Encyclopedia of Chemical Technology, Fourth Edition, Vol. 11. pages 492 and specifically as described by Bierschenk et al. in U.S. Pat. Nos. 4,827,042, 4,760,198, 4,931,199, and 5,093,432, and using the suitable starting materials with the proper end groups, compositions disclosed can be prepared.

The hydrocarbon polyether can be combined with an inert solvent such as 1,1,2-trichlorotrifluoroethane to produce a fluorination mixture, optionally in the presence of a hydrogen fluoride scavenger such as sodium or potassium fluoride. A fluid mixture containing fluorine and an inert diluent such as nitrogen can be introduced to the fluorination mixture for a sufficient period of time to convert essentially all hydrogen atoms to fluorine atoms. The flow rate of the fluid can be in the range of from about 1 to about 25000 ml/min, depending on the size of the fluorination mixture. The fluoropolyether can also be introduced after the introduction of the fluorine-containing fluid at a rate such that a perfluorination of the fluoropolyether can be accomplished.

$$C_rH_{(2r+1)}O{-}(CH(CH_3)CH_2{-}O)_wC_rH_{(2r+1)} + F_2 \longrightarrow C_rF_{(2r+1)}O{-}(CF(CF_3)CF_2{-}O)_wC_rF_{(2r+1)};$$

$$C_rH_{(2r+1)}O{-}(C_2H_4{-}O)_wC_rH_{(2r+1)} + F_2 \longrightarrow C_rF_{(2r+1)}O{-}(C_2F_4{-}O)_wC_rF_{(2r+1)};$$

$$C_rH_{(2r+1)}O{-}(C_2H_4{-}O)_w(C_3H_6{-}O_wC_rH_{(2r+1)} + F_2 \longrightarrow C_rF_{(2r+1)}O{-}(C_2F_4{-}O)_w(C_3F_6{-}O)_wC_rF_{(2r+1)};$$

$$C_rH_{(2r+1)}O{-}(CH_2CH_2CH_2{-}O)_w(CH(CH_3)CH_2{-}O)_uC_rH_{(2r+1)} + F_2 \longrightarrow C_rH_{(2r+1)}O{-}(CF_2CF_2CF_2{-}O)_w(CF(CF_3)CF_2{-}O)_uC_rH_{(2r+1)}$$

where u is 0 to 100.

Process 7 discloses the synthesis of PFPEs terminated with a $C_3$ to $C_6$ initial end group and a branched $C_3$ final end group. The reagents are those described in steps 1 to 4 of Process 1, or in step 1 of Process 3, followed by steps 2 to 4 of Process 1 to provide a starting alcohol. An alcohol having either branched or normal starting end can be reacted with sulfur tetrafluoride ($SF_4$) or a derivative of $SF_4$ such as N,N,-diethylaminosulfur trifluoride or a phosphorus pentahalide $PX_5^2$ such as phosphorous pentabromide, where $X^2$ is Br, Cl, or F at temperatures of about 25 to about 150° C. and autogenous pressure with or without solvent gives the terminal dihydrohalide which can be fluorinated according to step 7 of process 1, as illustrated below.

$$(C_3\text{-}C_6\ \text{Segment})(HFPO)_sCF(CF_3)CH_2OH + SF_4 \longrightarrow (C_3\text{-}C_6\ \text{Segment})(HFPO)_sCF(CF_3)CH_2F,$$

$$(C_3\text{-}C_6\ \text{Segment})(HFPO)_sCF(CF_3)CH_2F + F_2 \longrightarrow (C_3\text{-}C_6\ \text{Segment})(HFPO)_sCF(CF_3)_2,$$

$$\{R_f^8(R_f^9)CFO\ \text{Segment}\}(HFPO)_sCF(CF_3)CH_2OH + SF_4 \longrightarrow \{R_f^8(R_f^9)CFO\ \text{Segment}\}(HFPO)_sCF(CF_3)CH_2F;$$

$$\{R_f^8(R_f^9)CFO\ \text{Segment}\}(HFPO)_sCF(CF_3)CH_2F + F_2 \longrightarrow \{R_f^8(R_f^9)CFO\ \text{Segment}\}(HFPO)_sCF(CF_3)_2.$$

$$(C_3\text{-}C_6\ \text{Segment})(CH_2CF_2CF_2O)_tCH_2CF_2CH_2OH + SF_4 \longrightarrow (C_3\text{-}C_6\ \text{Segment})(CH_2CF_2CF_2O)_tCH_2CF_2CH_2F$$

$$(C_3\text{-}C_6\ \text{Segment})(CH_2CF_2CF_2O)_tCH_2CF_2CH_2F + F_2 \longrightarrow (C_3\text{-}C_6\ \text{Segment})(CF_2CF_2CF_2O)_tCF_2CF_2CF_3$$

Process 8 discloses the synthesis of PFPEs terminated with a $C_3$ to $C_6$ initial end group and specifically a perfluorotertiary final end group. Here, either a salt of any fluorotertiary alcohol such as perfluoro-t-butanol, or perfluoro-t-butyl hypofluorite is reacted with any fluoropolyether with a starting $C_3$-$C_6$ or $R_f^8(R_f^9)CFO$ segment and either a —A—O—C($CF_3$)═$CF_2$ or —A—O—C($CF_3$)═CHF terminus as shown. The resulting product is then fluorinated, if necessary.

$$(C_3\text{-}C_6\ \text{Segment})\text{-A—O—C}(CF_3)\text{═}CF_2 + M^1OC(CF_3)_3 \longrightarrow (C_3\text{-}C_6\ \text{Segment})\text{-A—O—CH}(CF_3)CF_2OC(CF_3)_3,$$

$$(C_3\text{-}C_6\ \text{Segment})\text{-A—O—CH}(CF_3)CF_2OC(CF_3)_3 + F_2 \longrightarrow (C_3\text{-}C_6\ \text{Segment})\text{-A—O—CF}(CF_3)CF_2OC(CF_3)_3,$$

$$\{R_f^8(R_f^9)\text{CFO Segment}\}\text{-A—O—C}(CF_3)\text{═}CF_2 + M^1OC(CF_3)_3 \longrightarrow \{R_f^8(R_f^9)\text{CFO Segment}\}\text{-A—O—CH}(CF_3)CF_2OC(CF_3)_3,$$

$$\{R_f^8(R_f^9)\text{CFO Segment}\}\text{-A—O—CH}(CF_3)CF_2OC(CF_3)_3 + F_2 \longrightarrow \{R_f^8(R_f^9)\text{CFO Segment}\}\text{-A—O—CF}(CF_3)CF_2OC(CF_3)_3,$$

$$(C_3\text{-}C_6\ \text{Segment})\text{-A—O—CF}(CF_3)CF_2OC(CF_3)_3,$$

$$\{R_f^8(R_f^9)\text{CFO Segment}\}\text{-A—O—C}(CF_3)\text{═}CF_2 + FOC(CF_3)_3 \longrightarrow \{R_f^8(R_f^9)\text{CFO Segment}\}\text{-A—O—CF}(CF_3)CF_2OC(CF_3)_3$$

While the procedures for replacing end groups with $C_3$-$C_6$ end groups can also be practiced on the FOMBLIN fluids described above, the value of inserting the more stable end groups is severely limited due to the presence of the chain destabilizing —O—$CF_2$—O— segments therein.

The PFPE fluids of the invention can be purified by any means known to one skilled in the art such as contact with absorbing agents, such as charcoal or alumina, to remove polar materials and fractionated conventionally by distillation under reduced pressure by any method known to one skilled in the art.

According to the fourth embodiment of the invention, a thermally stable grease or lubricant composition is provided. Greases containing the perfluoropolyether disclosed in the first embodiment of the invention can be produced by combining the perfluoropolyether with a thickener. Examples of such thickeners include, but are not limited to, standard thickeners such as, for example, poly(tetrafluoroethylene), fumed silica, and boron nitride, and combinations of two or more thereof. The thickeners can be present in any appropriate particle shapes and sizes as known to one skilled in the art.

According to the invention, the perfluoropolyether of the invention can be present in the composition in the range of from about 0.1 to about 50, preferably 0.2 to 40, percent by weight. The composition can be produced by any methods known to one skilled in the art such as, for example, by blending the perfluoropolyether with the thickener.

EXAMPLES

Example 1 and Comparative Examples A and B

Separation of F[CF($CF_3$)$CF_2$O]$_6$CF($CF_3$)$_2$ (IPA-F, Example 1), F[CF($CF_3$)—$CF_2$—O]$_6$—$CF_2CF_3$ (EF, Comparative Example A) and F[CF($CF_3$)—$CF_2$—O]$_7$—$CF_2CF_3$ (EF, Comparative Example B) from KRYTOX® Fluid (F[CF($CF_3$)—$CF_2$—O]$_1$—$R_f$, 1=3-11) by Fractional Distillation.

Samples for the aforementioned Examples were obtained via successive fractional vacuum distillations of KRYTOX Heat Transfer Fluids. In the first distillation, a 100 -cm long, 3 -cm ID (inner diameter) column was used. The column was packed with Raschig rings made from ¼" OD (outer diameter)/3⁄16" ID FEP (fluorinated ethylene polypropylene) tubing (obtained from Aldrich, Milwaukee, Wis.) cut into pieces about ¼" long. The distillation was carried out under dynamic vacuum conditions, and a pure sample of F[CF($CF_3$)—$CF_2$—O]$_7$—$CF_2CF_3$ (Comparative Example B) (approximately 350 g) was obtained at an overhead temperature of 88-92° C. as a fraction. At this point, previous fractions were combined and fluorinated with elemental fluorine at 100° C. in the presence of NaF in order to totally remove any hydrogen containing materials prior to the second distillation.

For the second distillation, a 120-cm long, 2.4-cm ID column packed with ¼" Monel saddle-shaped packing was used. This distillation was again carried out under dynamic vacuum (about 20 mTorr, 2.7 kPa), and pure samples of F[CF($CF_3$)—$CF_2$—O]$_6$—$CF_2CF_3$ (Comparative Example A) with an overhead temperature of 68-72° C. (200 g) and F[CF($CF_3$)—$CF_2$—O]$_6$—CF($CF_3$)$_2$ (Example 1) with an overhead temperature of 72-73° C. (85 g) were collected.

Example 2

This example illustrates the production of a perfluoropolyether having paired perfluoro-n-propyl end groups.

Addition of Hexafluoropropene (HFP) to a Perfluoropolyether Alcohol $$F[CF(CF_3)CF_2O]_5CF(CF_3)CH_2OH + CF_2{=}CFCF_3 \longrightarrow F[CF(CF_3)CF_2O]_6CF(CF_3)CH_2OCF_2CHFCF_3$$

A perfluoropolyether alcohol (KRYTOX alcohol, available from E.I. du Pont de Nemours and Company, Wilmington, Del.; 100.00 g) was added to a 250-ml round-bottomed flask. Acetonitrile (160 ml) and finely ground potassium hydroxide (4.87 g, 86.8 mmol) was then added to the flask with a magnetic stir bar to make a reaction mixture. Once the flask was connected to a vacuum line, the mixture was degassed. Upon vigorous stirring, the reaction mixture was heated to 60° C. When the temperature reached 60° C., a constant pressure of 650 mmHg (87 kPa) of hexafluoropropene was applied to the same flask. Stirring and applied pressure was maintained until the reaction did not take up any more hexafluoropropene. A color change was observed during the reaction from a light yellow to a dark orange when the reaction was completed. After the reaction, water was added to the reaction mixture and the bottom layer was removed via a separatory funnel. This was done three times to insure a clean product. Lastly, any solvent in the fluorous product layer was stripped by vacuum. Final mass of product, a perfluoropolyether-alcohol HFP adduct, was 97.77 g (86.5% yield).

Fluorination of Perfluoropolyether-alcohol HFP Adduct $$F[CF(CF_3)CF_2O]_6CF(CF_3)CH_2OCF_2CHFCF_3 + 20\%\ F_2 / 80\%\ N_2 \longrightarrow F[CF(CF_3)CF_2O]_7O(CF_2)_2CF_3$$

1,1,2-Trichlorotrifluoroethane (500 ml) and potassium fluoride (13.13 g, 22.6 mmol) were added to a fluorination reactor. Upon addition, the reactor was quickly closed and purged with dry nitrogen for 30 min at a rate of 300 ml/min.

Next, the reactor was purged with 20% fluorine/80% nitrogen for 30 min at a flow of 250 ml/min. The perfluoropolyether-alcohol HFP adduct (97.77 g) was then added to the reactor via a pump at a rate of 0.68 ml/min with 480-490 m/min flow of 20% fluorine, at a reactor stir rate of 800 rpm and a temperature of 25-28° C. for 76 min. In the next 30 min, the pump line was washed with an additional 20 ml of 1,1,2-trichlorotrifluoroethane. After a 106 min run time, the flow of fluorine was reduced to 250 ml/min for the next 60 min and then 40 ml/min with a stir rate of 600 rpm for the next 2 days. After the reaction, the system was purged with nitrogen. The product was removed and washed with water. The bottom layer was removed with a separatory funnel and the 1,1,2-trichlorotrifluoroethane was stripped from the product via the vacuum line. Final mass of the product was 91.96 g.

Example 3A

This example illustrates the production of a perfluoropolyether having an initial perfluoro-n-propyl end group and a final perfluoro-n-hexyl end group.

Addition of 1-Perfluorohexene to a Perfluoropolyether Alcohol (1)

$$F[CF(CF_3)CF_2O]_5CF(CF_3)CH_2OH + (H_3C)_2CHO^-Na^+ \longrightarrow F[CF(CF_3)CF_2O]_5CF(CF_3)CH_2ONa$$

(2)

$$F[CF(CF_3)CF_2O]_5CF(CF_3)CH_2ONa + CF_2{=}CF(CF_2)_3CF_3 \longrightarrow F[CF(CF_3)CF_2O]_5CF(CF_3)CH_2OCF{=}CF(CF_2)_3CF_3 + F[CF(CF_3)CF_2O]_5CF(CF_3)CH_2OCF_2{-}CHF(CF_2)_3CF_3$$

A perfluoropolyether alcohol, KRYTOX alcohol (available from E. I. du Pont de Nemours and Company, Wilmington, Del.; 74.6 g) was added to a 500-ml round-bottomed flask containing 6.25 g $(H_3C)_2CHONa$. After the colorless solid dissolved under stirring with the KRYTOX alcohol the iso-propanol byproduct was removed under vacuum yielding 76.3 g liquid sodium salt (100% yield). The flask was cooled with liquid nitrogen and anhydrous acetonitrile (88 g) and perfluoro-1-hexene (24.0 g) were then added to the flask by vacuum transfer. After reaching room temperature the mixture was stirred to start a mildly exothermic reaction. After the reaction, the acetonitrile and un-reacted $C_6F_{12}$ were removed leaving 93.6 g of a non-volatile residue. The weight increase (17.3 g) indicated a 75.7% yield of crude product. Aqueous ammonium chloride solution was added to the reaction mixture, which was subsequently transferred into a separatory funnel. Phase separation was accomplished by adding a small amount of acetone and prolonged heating of the funnel to 90° C. The lower layer was drained into a 250-ml round-bottomed flask and vacuum distilled via a 12 cm Vigreux column. 56.3 g of a mixture of saturated and unsaturated products were isolated.

Fluorination of Perfluoropolyether-alcohol Perfluorohexene Adduct $$F[CF(CF_3)CF_2O]_5CF(CF_3)CH_2OCF{=}CF(CF_2)CF_3 + F[CF(CF_3)CF_2O]_5CF(CF_3)CH_2OCF{-}CHF(CF_2)CF_3 +$$

-continued $$F_2\,(20\%)\,/\,N_2\,(80\%) \longrightarrow F[CF(CF_3){-}CF_2O]_6(CF_2)_5CF_3$$

The products of the above procedure were combined in a FEP (FEP fluoropolymer, a tetrafluoroethylene/hexafluoropropylene copolymer) tube reactor (O.D. ⅝ in [1.6 cm]) equipped with an FEP dip-tube and treated with 20% $F_2$/80% $N_2$ at ambient temperature at a rate of ca. 30 ml/min for 2 days at which time the contents were transferred to a 300 ml stainless steel cylinder also equipped with a dip tube. Fluorination was continued for a day at 95° C. at a similar flow rate. 22.2 g of pure product were isolated. The product was identified by its characteristic mass spectrum.

Example 3B (1)

$$F[CF(CF_3)CF_2O]_5CF(CF_3)CH_2OH + NaH \longrightarrow F[CF(CF_3)CF_2O]_5CF(CF_3)CH_2ONa$$

(2)

$$F[CF(CF_3)CF_2O]_5CF(CF_3)CH_2ONa + H_2C{=}CH(CF_2)_3CF_3 \longrightarrow F[CF(CF_3)CF_2O]_5CF(CF_3)CH_2OCH_2{-}CH{=}CF(CF_2)_2CF_3$$

A perfluoropolyether alcohol (KRYTOX alcohol, available from E. I. du Pont de Nemours & Company, Wilmington, Del.; 55.51 g) of average molecular weight of 1586 g/mole was poured into a 50-ml round-bottomed flask with tetrahydrofuran (25 ml) and agitated with magnetic stirring. Next, sodium hydride (2.00 g, 0.084 mole) was added slowly via an addition funnel to the same reaction flask. The contents were stirred until no more evolution of hydrogen gas was evident. 1H,1H,2H-Perfluorohexane, (ZONYL PFBE, perfluorobutylethylene, available from E. I. du Pont de Nemours and Company, Wilmington, Del.; 35 ml, 0.207 mole) was then added in a 6-mole excess to the poly (hexafluoropropylene oxide) sodium alkoxide and refluxed at 59° C. for 24 hr. According to $^1$H-NMR the percent conversion to the n-hexyl intermediate was calculated to be 86%. Yield of total oil=44.89 g.

$$F[CF(CF_3)CF_2O]_{nn}CF(CF_3)CH_2OCH_2{-}CH{=}CF(CF_2)_2CF_3 + F_2\,(20\%)/N_2\,(80\%) \longrightarrow F[CF(CF_3){-}CF_2O]_{(nn+1)}(CF_2)_5CF_3$$

where nn is a number of 5 to 15.

The product of the above procedure were combined in an FEP tube reactor (O.D. ⅝") equipped with an FEP dip-tube and treated with 20% F2/80% N2 at ambient temperature at a rate of ca. 30 ml/min for 2 days at which time the contents were transferred to a 300 ml stainless steel cylinder also equipped with a dip tube. Fluorination was continued for a day at 95° C. at a similar flow rate. The product was identified by its characteristic mass spectrum.

TEST METHOD AND RESULTS

Test Method. Procedure for Measuring Thermal Stability

A 75-ml stainless steel HOKE cylinder topped with a 10-cm stainless steel spacer and valve was used to contain the poly(HFPO) sample for each thermal stressing experiment. The mass of the cylinder was taken and recorded after every step in the procedure. In a dry box, the cylinder was charged with $AlF_3$ (ca. 0.05 g), weighed, and then charged with about 1 g sample of monodisperse poly(HFPO) containing different end groups. (The $AlF_3$ used in these experiments was synthesized by the direct fluorination of $AlCl_3$ and was shown by X-ray powder diffraction to largely be amorphous.) The cylinder was then removed from the dry box and placed in a thermostatic oil bath at a predetermined temperature in the range of 200-270±1.0° C. The valve was kept cool by diverting a stream of room-temperature compressed air over it. After a period of 24 hours, the cylinder was cooled to room temperature, weighed, and then cooled further to liquid nitrogen temperature (−196° C.). Any non-condensable materials were stripped from the cylinder under dynamic vacuum. The cylinder was then warmed to room temperature, and the volatile materials were removed by vacuum transfer and stored for later analysis by FT-IR and NMR spectroscopy. Methanol was then added to the cylinder to convert any acid fluorides that might have resulted from the degradation to their corresponding methyl esters. The resulting non-volatile material was then separated from any unreacted methanol and analyzed by GC-mass spectrometry. The results from this experiment as well as those from additional and related experiments where the monodisperse poly(HFPO) samples have either perfluoroisopropyl, perfluoroethyl, perfluoro-n-propyl, or perfluoro-n-hexyl end-groups are shown in Table 1.

TABLE 1

| | Temperature (° C.) | | | | | | | |
|---|---|---|---|---|---|---|---|---|
| | 200 | 210 | 220 | 230 | 240 | 250 | 260 | 270 |
| Percent of $F[HFPO]_6$—$CF_2CF_3$ (Comparative Example A) degraded | —[a] | 37.4[c] | 96.3[c] | — | — | — | — | — |
| Percent of $F[HFPO]_7$—$CF_2CF_3$ (Comparative Example B) degraded | 1.8 | 30.8 | — | — | — | — | — | — |
| Percent of $F[HFPO]_6$—$CF(CF_3)_2$ (Example 1) degraded | — | 6.2 | 14.2[b], 13.6 | 12.6 | 11.7 | 76.8 | 51.9 | 86.2 |
| Percent of $F[HFPO]_7$—$CF_2CF_2CF_3$ (Example 2) degraded | — | — | 86.5 | — | — | — | 81.8 | — |
| Percent of $F[HFPO]_6$—$(CF_2)_5(CF_3)$ (Example 3) degraded | — | — | 59.4 | — | — | 100 | — | — |

—[a], not determined
[b]Replicates,
[c]Average of triplicates.

Table 1 shows a substantial reduction in the amount of degradation of a poly(HFPO) fluid having a normal perfluoropropyl group on one end and any group $C_3$ to $C_6$ on the other as compared with the poly(HFPO) containing a normal perfluoropropyl end group on one end and perfluoroethyl end group on the other, demonstrating the greater stabilizing effect of the perfluoro $C_3$ to $C_6$ terminal groups.

What is claimed is:

1. A process for producing a perfluoropolyether having the formula $$C_rF_{(2r+1)}—A—C_rF_{(2r+1)}$$

in which each r is independently 3 to 6; if r=3, both end groups $C_rF_{(2r+l)}$ are perfluoropropyl radicals; A can be $O—(CF(CF_3)CF_2—O)_w$, $O—(CF_2—O)_x(CF_2CF_2—O)_y$, $O—(C_2F_4—O)_x$, $O—(C_2F_4—O)_x(C_3F_6—O)_y$, $O—(CF(CF_3)CF_2—O)_x(CF_2—O)_y$, $O(CF_2CF_2CF_2O)_w$, $O—(CF(CF_3)CF_2—O)_x(CF_2CF_2—O)_{y—(CF2—O)_z}$, or combinations of two or more thereof; w is 4 to 100; x, y, and z are each independently 1 to 100 comprising (1) contacting a reactant with a metal halide to produce an alkoxide wherein said reactant is selected from the group consisting of a perfluoro acid halide, a $C_2$ to $C_4$-substituted ethyl epoxide, a $C_{3+}$ fluoroketone, and combinations or two or more thereof; (2) contacting said alkoxide with hexafluoropropylene oxide or tetrafluorooxetane to produce a second acid halide; (3) esterifying said second acid halide to an ester; (4) reducing said ester to its corresponding alcohol; (5) converting said corresponding alcohol with a base to a salt; (6) contacting said salt with a $C_{3+}$ olefin or perfluoroalkene to produce a fluoropolyether; and (7) fluorinating said fluoropolyether.

2. A process according to claim 1 wherein said $C_{3+}$ olefin is a $C_3$-$C_6$ straight chain olefin, $C_3$-$C_6$ branched chain olefin, $C_3$-$C_6$ allyl halide, or combinations of two or more thereof.

3. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) esterifying said second acid halide to an ester; (4) reducing said ester to an alcohol; (5) contacting said alcohol with a base to produce a salt; (6) contacting said salt with a $C_3$ or higher olefin to produce a fluoropolyether; and (7) fluorinating said fluoropolyether.

4. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) esterifying said second acid halide to an ester; (4) reducing said ester to an alcohol; (5) contacting said alcohol with a base to produce a salt; (6) contacting said salt with a $C_{3+}$ branched fluoroalkene or a $C_{3+}$ allyl halide to produce a fluoropolyether; and (7) fluorinating said fluoropolyether.

5. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) esterifying said second acid halide to an ester; (4) contacting said ester with a Grignard reagent to produce a carbinol; and (5) dehydrating or fluorinating said carbinol.

6. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce a second acid halide; (3) esterifying said second acid halide to an ester; (4) contacting said ester with a Grignard reagent to produce a carbinol; and (5) dehydrating or fluorinating said carbinol.

7. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce a second acid halide; (3) esterifying said second acid halide to an ester; (4) reducing said ester to an alcohol; (5) contacting said alcohol with a base to produce a salt; (6) contacting said salt with a $C_{3+}$ olefin to produce a fluoropolyether; and (7) fluorinating said fluoropolyether.

8. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce a second acid halide; (3) esterifying said second acid halide to an ester; (4) reducing said ester to its corresponding alcohol; (5) converting said corresponding alcohol with a base to a salt; (6) contacting said salt with a $C_{3+}$ fluoroalkene to produce a fluoropolyether; and (7) fluorinating said fluoropolyether.

9. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) contacting said second acid halide with a metal iodide to produce a second iodide; (4) fluorinating said second iodide.

10. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce an acid halide; (3) contacting said acid halide with a metal iodide to produce a second iodide; and (4) fluorinating said second iodide.

11. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) contacting said second acid halide with a metal iodide to produce a second iodide; (4) contacting said second iodide with an olefin to produce a third iodide; and (5) fluorinating said third iodide.

12. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce an acid halide; (3) contacting said acid halide with a metal iodide to produce a second iodide; (4) contacting said second iodide with an olefin to produce a third iodide; and (5) fluorinating said third iodide.

13. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) contacting said second acid halide with a metal iodide to produce a second iodide; (4) contacting said second iodide with an olefin to produce a third iodide; (5) dehydrohalogenating said third iodide to give a second olefin; and (6) fluorinating said second olefin.

14. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce an acid halide; (3) contacting said acid halide with a metal iodide to produce a second iodide; (4) contacting said second iodide with an olefin to produce a third iodide; (5) dehydrohalogenating said third iodide to give a second olefin; and (6) fluorinating said second olefin.

15. A process according to claim 1 wherein said process comprises fluorinating a fluoropolyether having alkyl radical end groups; said radical has at least 3 carbon atoms per radical and is substantially free of methyl and ethyl; and a 1,2-bis(methyl)ethylene diradical, —$CH(CH_3)CH(CH_3)$—, is absent in the molecule of said fluoropolyether.

16. A process according to claim 15 wherein said process is carried out in the presence of a mixture comprising an inert solvent and a hydrogen fluoride scavenger.

17. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) contacting said second acid halide with a metal iodide to produce a second iodide; (4) replacing the iodine radicals of said second iodide with hydrogen radicals to produce a fluoropolyether containing hydrogen radicals; and (5) fluorinating said fluoropolyether.

18. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce an acid halide; (3) contacting said acid halide with a metal iodide to produce a second iodide; (4) replacing the iodine radicals of said second iodide with hydrogen radicals to produce a fluoropolyether containing hydrogen radicals; and (5) fluorinating said fluoropolyether.

19. A process according to claim 1 wherein said process comprises (1) contacting a perfluoro acid halide or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) contacting said second acid halide with a metal iodide to produce a second iodide; (4) contacting said second iodide with an olefin to produce a third iodide; (5) replacing the iodine radicals of said second iodide with hydrogen radicals to produce a fluoropolyether containing hydrogen radicals; and (6) fluorinating said fluoropolyether.

20. A process according to claim 1 wherein said process comprises (1) contacting a $C_3$ to $C_6$ fluoroketone with a metal halide to produce an alkoxide; (2) contacting said alkoxide with hexafluoropropylene oxide or tetrafluorooxetane to produce an acid halide; (3) contacting said acid halide with a metal iodide to produce a second iodide; (4) contacting said second iodide with an olefin to produce a third iodide; (5) replacing the iodine radicals of said second iodide with hydrogen radicals to produce a fluoropolyether containing hydrogen radicals; and (6) fluorinating said fluoropolyether.

21. A process according to claim 1 wherein said process comprises (1) contacting a perfluoro acid halide, a $C_3$ to $C_6$ fluororoketone, or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) esterifying said second acid halide to an ester; (4) reducing said ester to an alcohol; (5) contacting said alcohol with sulfur tetrafluoride or derivative thereof to convert the OH groups of said alcohol to fluorine radicals thereby producing a fluoropolyether; and (6) fluorinating said fluoropolyether.

22. A process according to claim 1 wherein said process comprises (1) contacting a perfluoro acid halide, a $C_3$ to $C_6$ fluoroketone, or a $C_2$ to $C_4$-substituted ethyl epoxide with a metal halide to produce an alkoxide; (2) contacting said alkoxide with hexafluoropropylene oxide or tetrafluorooxetane to produce a second acid halide; (3) esterifying said second acid halide to an ester; (4) reducing said ester to an alcohol; (5) contacting said alcohol with a phosphorus pentahalide or derivative thereof to convert the OH groups of said alcohol to halide radicals thereby producing a fluoropolyether; and (6) fluorinating said fluoropolyether.

23. A process according to claim 1 wherein said process comprises (1) contacting a fluorotertiary alkoxy-containing compound with a first fluoropolyether to produce a second fluoropolyether and optionally (2) fluorinating said second fluoropolyether wherein said fluorotertiary alkoxy-containing compound is a salt of a fluorotertiary alcohol or a perfluoro-t-butyl hypofluorite; said first fluoropolyether has (i) a starting $C_3$-$C_6$ segment or $R_f^8(R_f^9)CFO$ segment and (ii) a —A—O—$C(CF_3)$═$CF_2$ or a —A—O—$C(CF_3)$═CHF intermediate end group; $R_f^8$ is $C_jF_{(2j+1)}$; $R_f^9$ is $C_kF_{(2k+1)}$; j and k are each ≧1; (j+k)≦5; and A is selected from the group consisting of O—$(CF(CF_3)CF_2—O)_w$, O—$(CF_2—O)_x$ $(CF_2CF_2—O)_y$, O—$(C_2F_4—O)_x$, O—$(C_2F_4—O)_x$ $(C_3F_6—O)_y$, O—$(CF(CF_3)CF_2—O)_x(CF_2—O)_y$, $O(CF_2CF_2CF_2O)_w$, O—$(CF(CF_3)CF_2—O)_x(CF_2CF_2—O)_y$ —$(CF_2—O)_z$, and combinations of two or more thereof.

24. A process according to claim 23 wherein said fluorotertiary alkoxy-containing compound is a salt of a fluorotertiary alcohol.

25. A process according to claim 23 wherein said fluorotertiary alkoxy-containing compound is a perfluoro-t-butyl hypofluorite.

* * * * *

UNITED STATES PATENT AND TRADEMARK OFFICE

CERTIFICATE OF CORRECTION

PATENT NO. : 7,232,932 B2
APPLICATION NO. : 10/813525
DATED : June 19, 2007
INVENTOR(S) : Jon Lee Howell et al.

It is certified that error appears in the above-identified patent and that said Letters Patent is hereby corrected as shown below:

Col. 17, Line 66
Claim 1, line 66, delete "$_{-(CF2}$" and substitute therefor -- $-(CF_2$ --.

Col. 18, Line 5
Claim 1, line 5, delete "or two" and substitute therefor -- of two --.

Signed and Sealed this

Sixth Day of November, 2007

JON W. DUDAS
*Director of the United States Patent and Trademark Office*